US006000443A

United States Patent [19]

Hayashi et al.

[11] Patent Number: 6,000,443

[45] Date of Patent: Dec. 14, 1999

[54] BRAKE MECHANISM OF WIRE REEL FOR REINFORCING BAR BINDING MACHINE

[75] Inventors: Susumu Hayashi; Ichiro Kusakari; Syuichi Ishii; Osamu Itagaki, all of Tokyo, Japan

[73] Assignee: Max Co., Ltd., Tokyo, Japan

[21] Appl. No.: 09/166,526

[22] Filed: Oct. 6, 1998

[30] Foreign Application Priority Data

Oct. 6, 1997 [JP] Japan ..... 9-289079

[51] Int. Cl.[6] ..... B21F 15/04

[52] U.S. Cl. ..... 140/119; 140/53

[58] Field of Search ..... 140/53, 54, 57, 140/119

[56] References Cited

U.S. PATENT DOCUMENTS 5,778,946 7/1998 Pellenc et al. ..... 140/119

FOREIGN PATENT DOCUMENTS 1571735 6/1969 France .
WO 96/00135 1/1996 WIPO .

*Primary Examiner*—Lowell A. Larson
*Attorney, Agent, or Firm*—Morgan, Lewis & Bockius LLP

[57] ABSTRACT

A brake mechanism of a wire reel arranged in a reinforcing bar binding machine in which a binding wire 3 is fed from a wire reel 2, wound round reinforcing bars 7, and twisted by a twisting hook 8 so that the reinforcing bars can be bound with the binding wire, comprises the steps of: a brake means 11; and a brake lever 12 for operating the brake means 11, wherein the brake lever 12 is linked with a motor 9 for driving the twisting hook 8, the brake means 11 is operated by the brake lever 12 when the twisting motor 9 is normally rotated so that the brake means 11 is engaged with the circumferential edge portion of the wire reel 2 so as to apply the brake to the wire reel 2, and the brake lever 12 and the brake means 11 are reversely operated when the twisting motor 9 is reversed so that the braking operation can be released.

4 Claims, 8 Drawing Sheets

BRAKE MECHANISM OF WIRE REEL FOR REINFORCING BAR BINDING MACHINE

BACKGROUND OF THE INVENTION

The present invention relates to a brake mechanism for stopping the rotation of a wire reel of a reinforcing bar binding machine after a binding wire of a redetermined length has been fed out from the wire reel.

In general, in a reinforcing bar binding machine, a binding wire of a predetermined length is wound round reinforcing bars crossing with each other, and then this binding wire is twisted by a twisting hook so that the reinforcing bars can be bound up. The binding wire is wound round a wire reel attached at the rear of the binding machine body. In the case of feeding the wire, it is fed forward by a wire feeding means. At this time, the wire reel is rotated, and the wire is fed out from the wire reel. A length of the wire to be fed out is accurately controlled. Therefore, when the wire of a predetermined length is fed out, the feed of the wire is suddenly stopped.

However, the following problems may be encountered in the above wire feeding mechanism. Although the feed of the wire is suddenly stopped when the wire of a predetermined length is fed out from the wire reel, the wire reel continues to rotate redundantly by the action of inertia of the wire reel. Therefore, a diameter of the wire wound round the wire reel is increased, and the wires are entangled with each other. As a result, it becomes impossible to feed out the wire smoothly, and problems may be caused when the wire is fed out in the next stage.

In order to take measures to solve the above problems, it is possible to apply the brake to the wire reel by a leaf spring at all times so that the inertial rotation of the wire reel can be prevented. However, the following problems may be caused in this case. A load necessary for feeding the wire is increased, and an electrical current consumption of the wire feeding motor is increased. As a result, the wire feeding motor is heated and the feeding speed is lowered.

SUMMARY OF THE INVENTION

The present invention has been accomplished to solve the above problems. It is an object of the present invention to provide a brake mechanism of a wire reel of a reinforcing bar binding machine capable of applying the brake to the wire reel substantially simultaneously with the completion of feeding a wire of a predetermined length from the wire reel.

In order to solve the above problems, the present invention provides a brake mechanism of a wire reel of a reinforcing bar binding machine in which a binding wire is fed from a wire reel rotatably arranged at the rear of the binding machine body to the front of the binding machine body, wound round reinforcing bars crossing each other, and twisted by a twisting hook driven by a motor to bind the reinforcing bars with the binding wire, the brake mechanism comprising: breaking means for engaging with a circumferential edge portion of the wire reel; and a brake lever linked with the motor for driving the twisting hook such that, when the motor normally rotates, the brake lever operates the breaking means so as for the brake means engages with the circumferential edge portion of the wire reel so as to apply braking to the wire reel, and, when the motor reversly rotates, the brake lever reversely operates the brake means to release the breaking means from applying braking.

DETAILED DESCRIPTION OF THE PREFERRED EMBODIMENTS

Figure 1:
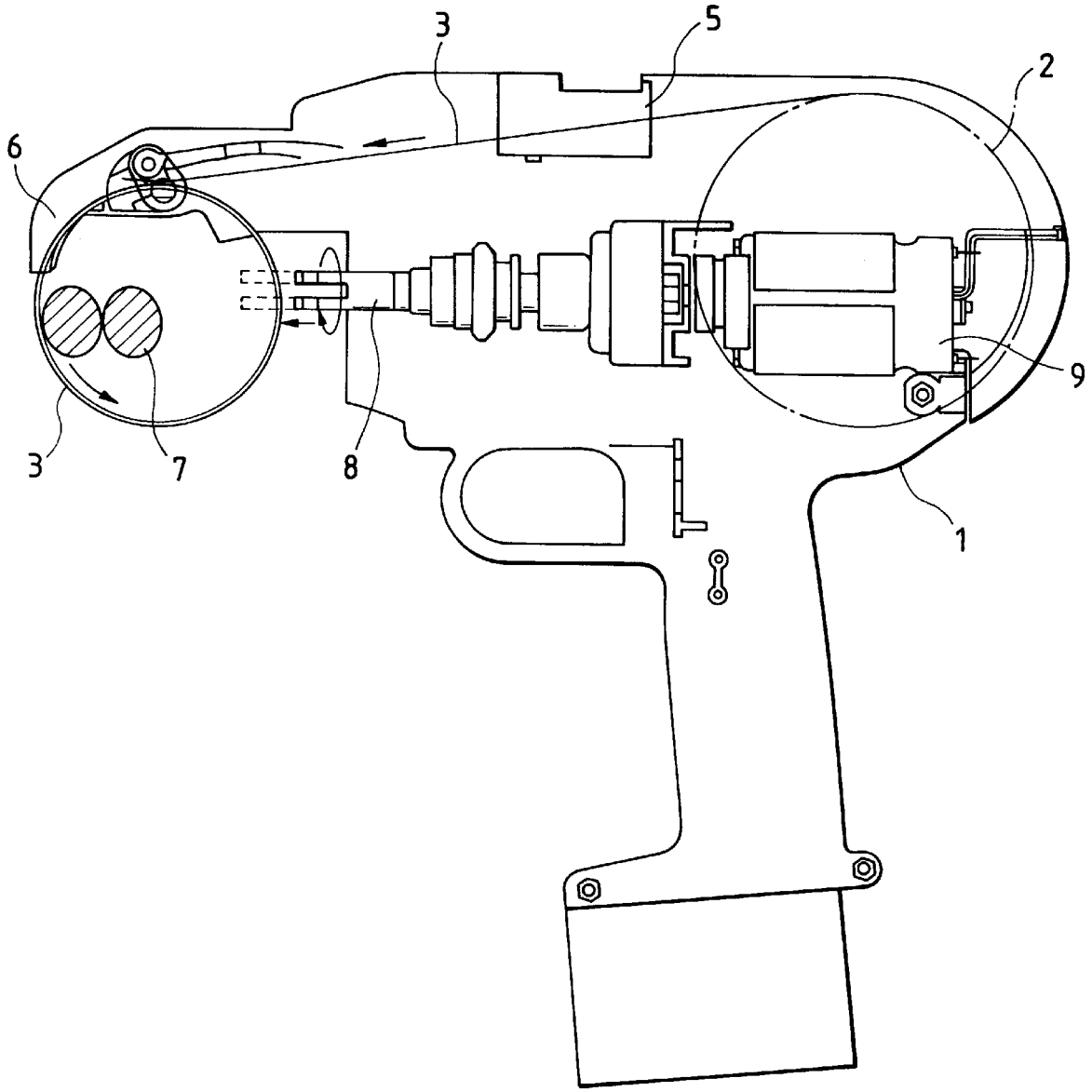
FIG. 1 is a longitudinally cross-sectional side view of an outline of a binding mechanism of a reinforcing bar binding machine according to an embodiment of the present invention.
Figure 2:
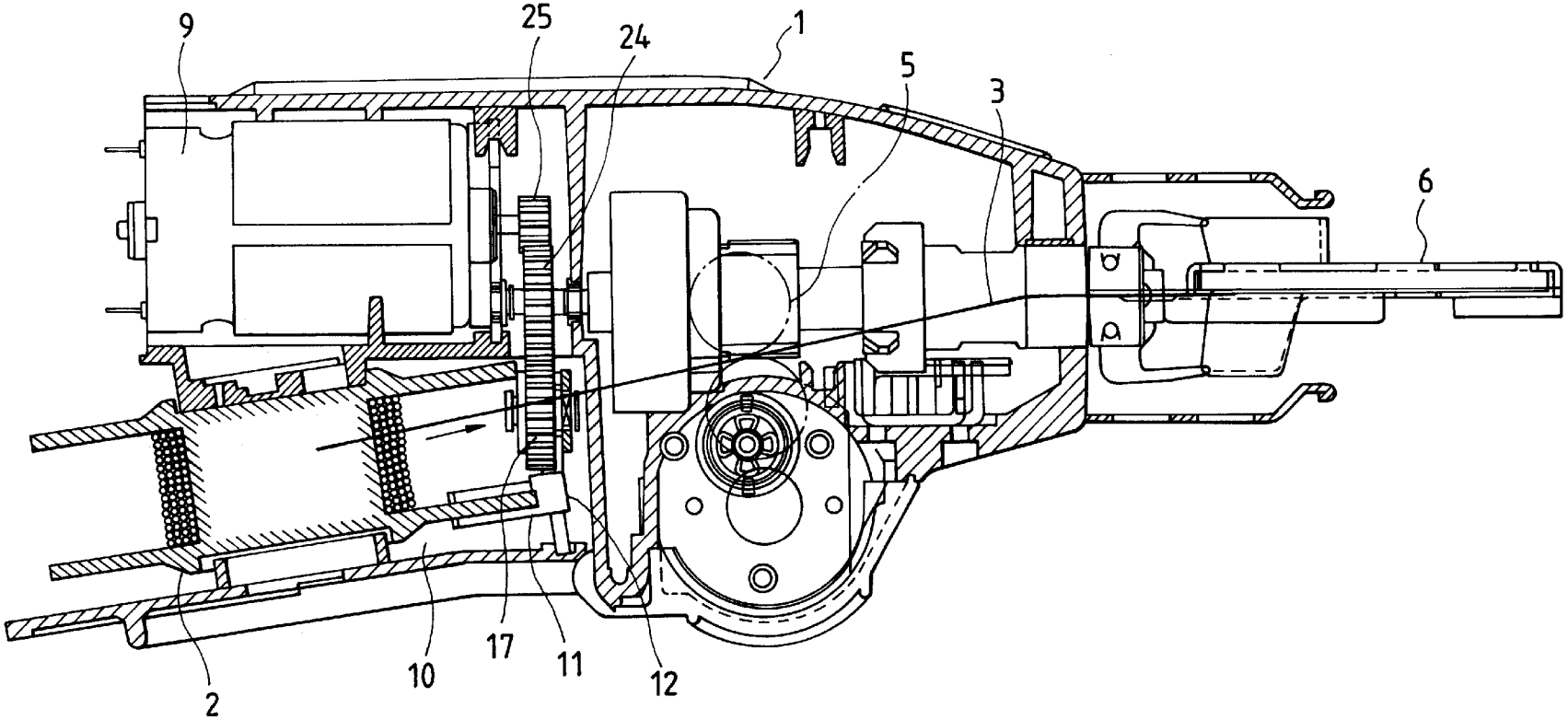
FIG. 2 is a plan view showing an outline of a binding mechanism and a wire reel brake mechanism according to the embodiment of the invention.

FIGS. 1 and 2 are respectively a side view and a plan view showing an outline of a binding mechanism arranged in a reinforcing bar binding machine according to an embodiment of the present invention.

In the drawings, a binding machine body 1 is provided, and a wire reel 12 rotatably arranged at the rear of the binding machine body 1. In the binding machine body 1, there is provided a wire passage (not shown) for a wire 3. In the passage, there is provided a feeding means for feeding the wire 3 to the front of the binding machine body 1. In the front of the binding machine body 1, there is provided a guide 6 for guiding the wire 3 so that it can be curved into a loop-shape by the guide 6. In the binding machine body 1, there is provided a twisting hook 8 for twisting the wire 3 wound round the circumference of the reinforcing bar 7. This twisting hook 8 is driven by the motor 9. In this connection, the feeding means 5 is also driven by another motor not shown in the drawing.

In the above reinforcing bar binding machine, binding is conducted as follows. The wire 3 of a predetermined length is fed out from the wire reel 2 by the feeding means 5. After the wire 3 has been wound round the reinforcing bars crossing each other, the twisting motor 9 is operated according to a signal sent from the feeding means 5, and the twisting hook 8 is driven by the twisting motor 9, so that the wire 3 can be twisted and binding can be conducted on the reinforcing bars crossing each other. In this connection, the twisting hook 8 is composed so that the following operation can be conducted. In the beginning of operation, the twisting hook 8 is normally rotated and proceeds to the loop of the wire 3, and the wire 3 is twisted by the twisting hook 8. After the completion of twisting, the twisting hook 8 is reversed and returned to the initial position.

The wire reel 2 is detachably accommodated in an accommodating section 10 formed on one side at the rear of the binding machine body 1. In this accommodating section 10, there are provided a brake means 11 capable of engaging with the circumferential edge portion of the wire reel 2, and a brake lever 12 for activating the brake means 11.

Figure 3:
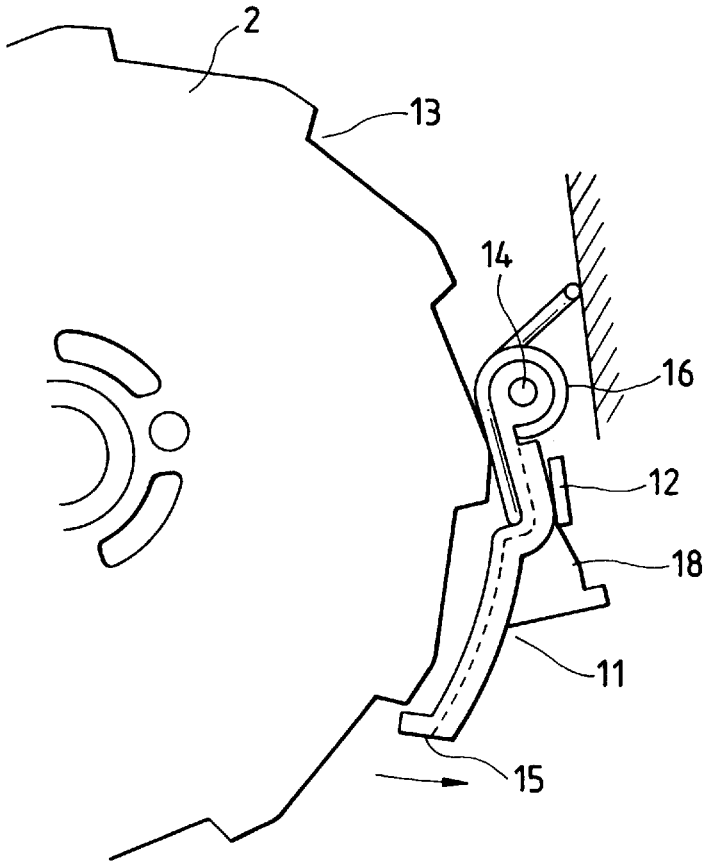
FIG. 3 is a side view of a primary portion of the brake mechanism in the case of releasing the brake.

As shown in FIG. 3, engaging recesses 13 are formed at regular intervals in the circumferential edge portion of the wire reel 2. The brake means 11 is arranged at a position opposed to this engaging recess 13 in such a manner that the brake means 11 is pivotable around the support shaft 14 arranged on both side walls of the accommodating section 10 for accommodating the wire reel. The brake means 11 includes: an engaging claw 15 capable of engaging with the engaging recess 13; and a sliding surface 18 on which the brake lever 12 is received. The brake means 11 is biased by the spring 16 in a direction so that the engaging claw 15 can be retracted from the circumferential edge portion of the wire reel 2.

Figure 4:
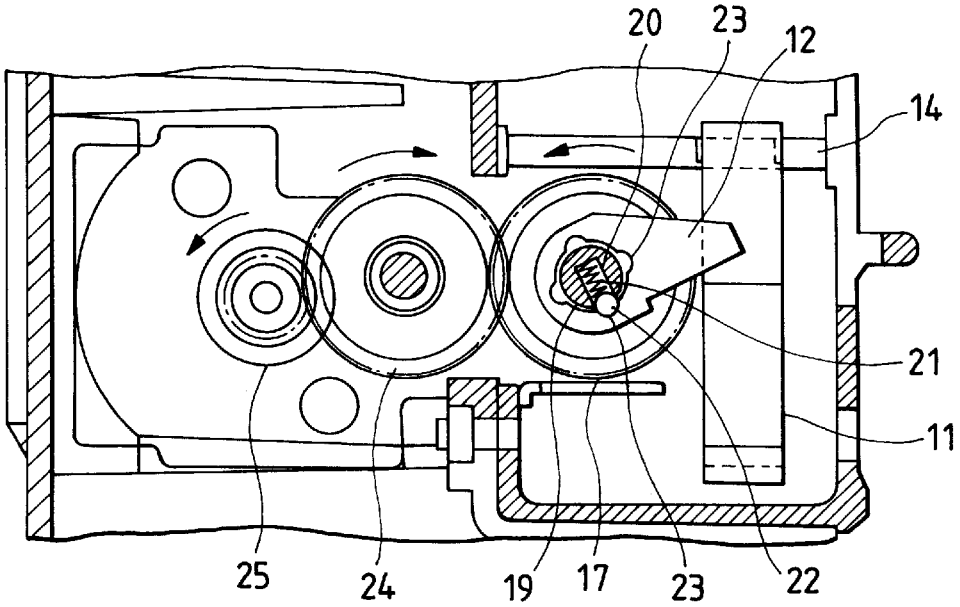
FIG. 4 is a front view of a rotary shaft and brake lever in the brake mechanism shown in FIG. 3.
Figure 5:
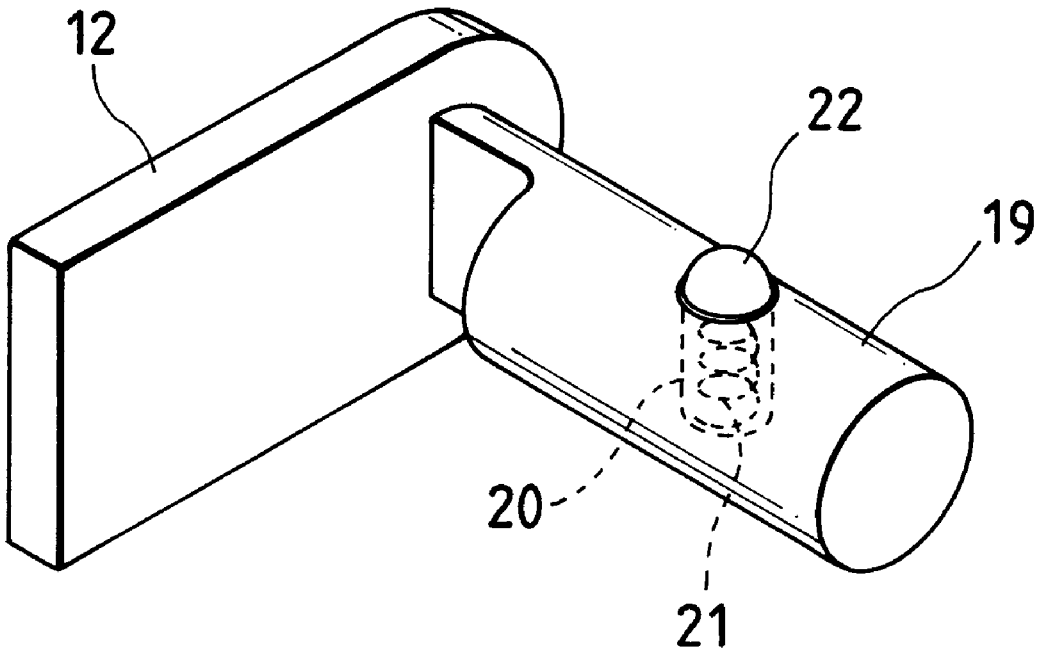
FIG. 5 is a perspective view of the brake lever.

The brake lever 12 is arranged being opposed to the brake means 11. As shown in FIGS. 3 and 4, the brake lever 12 is fixed to the rotary shaft 19 of the brake gear 17. In the rotary shaft 19, there is formed a hole 20 in the radial direction. In the hole 20, there are provided a compression spring 21 and a steel ball 22. As shown in FIG. 4, there are formed a plurality of recess grooves 23 for receiving the steel ball 22 on the circumferential surface of the bearing hole of the brake gear 17. Due to the above arrangement, the brake lever 12 is linked with the brake gear 17 by the action of the steel ball 22 and the compression spring 21. However, when a load, the intensity of which exceeds a predetermined value, only the gear 17 is idly rotated. Further, the brake gear 17 is meshed with the intermediate gear 24. Furthermore, the intermediate gear 24 is meshed with the gear 25 attached to the output shaft of the twisting motor 9.

Figure 6:
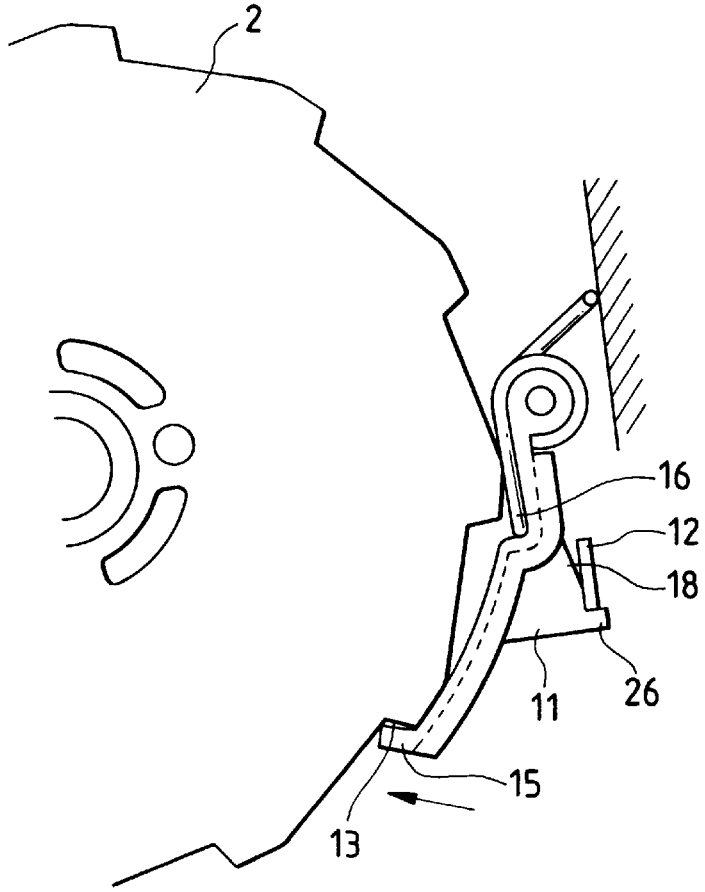
FIG. 6 is a schematic illustration for explaining operation of the brake mechanism in the case of applying the brake.
Figure 7:
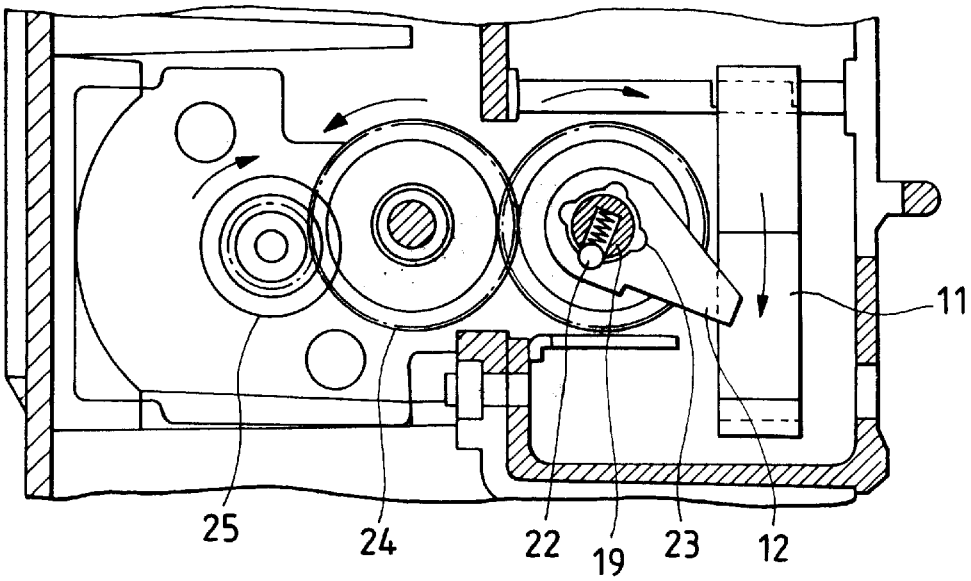
FIG. 7 is a schematic illustration for explaining operation of the brake lever of the brake mechanism shown in FIG. 6.

In the above arrangement, when the twisting motor 9 is normally rotated in accordance with the stoppage of operation of the wire feeding means 5, the rotation of the twisting motor 9 is transmitted to the brake gear 17 via the intermediate gear 24. When the brake gear 17 is rotated, the brake lever 12 is rotated downward being linked with the brake gear 17 since the steel ball 22 is engaged with the recess groove 23 by the action of the compression spring 21. When the brake lever 12 is rotated downward, it slides on the sliding surface 18 of the brake means 11 as shown in FIGS. 6 and 7. Accordingly, the brake means 11 is rotated resisting the spring 16, and the engaging claw 15 of the brake means 11 proceeds to the front and engages with the engaging recess 13 of the wire reel 2. Due to the foregoing, rotation of the wire reel 2 is forcibly stopped by the engaging claw 15. In this connection, the downward movement of the brake lever 12 is stopped by the stopper 26 arranged at the lower end portion of the sliding surface 18. Therefore, an intensity of load given to the brake lever 12 is increased. As a result, the steel ball 22 is disengaged from the recess groove 23. Then, the steel ball 22 is successively engaged with and disengaged from the recess groove 23, so that only the gear 17 is idly rotated.

After that, when the twisting motor 9 is reversed, the brake lever 12 is moved in the reverse direction. Therefore, the pushing force given to the brake means 11 is released, and the brake means 11 is rotated in the reverse direction by the spring force of the spring 16. Accordingly, the engaging claw 15 is retracted and disengaged from the wire reel 2. As a result, the brake means 11 is put into a state shown in FIG. 3, and the braking applied to the wire reel 2 is released. Due to the foregoing, preparation is made for the wire 3 in the next stage.

As described above, the twisting motor 9 is operated substantially simultaneously with the completion of feed of the wire 3 of a predetermined length. When the twisting motor 9 is normally rotated, the brake means 11 is operated, so that the brake is applied to the wire reel 2 and the rotation of the wire reel 2 is suddenly stopped. Due to the foregoing, there is no possibility that the wire reel 2 is rotated excessively and the diameter of the wire 3 is increased. Accordingly, it becomes possible to feed the wire 3 smoothly . Also it becomes possible to solve the problems such as an increase in the electric current consumption, generation of heat from the motor 9 and deterioration of wire feeding speed.

The twisting motor 9 is rotated normally and reversely. In the above arrangement, the braking is applied and released by utilizing the normal and reverse rotation of the twisting motor 9. Therefore, it is unnecessary to provide a specific drive control mechanism.

Figure 8:
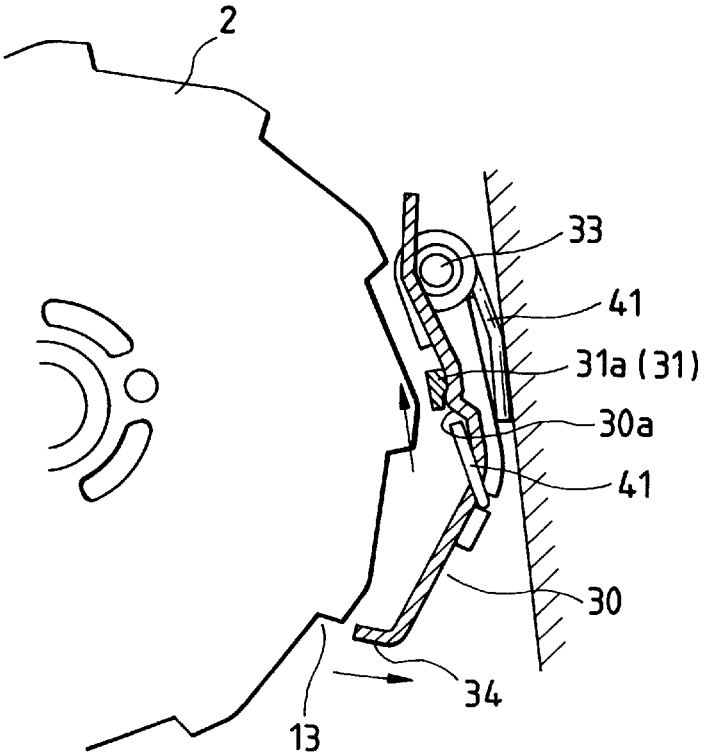
FIG. 8 is a side view of a primary portion of a brake mechanism of another example in the case of releasing the brake.
Figure 9:
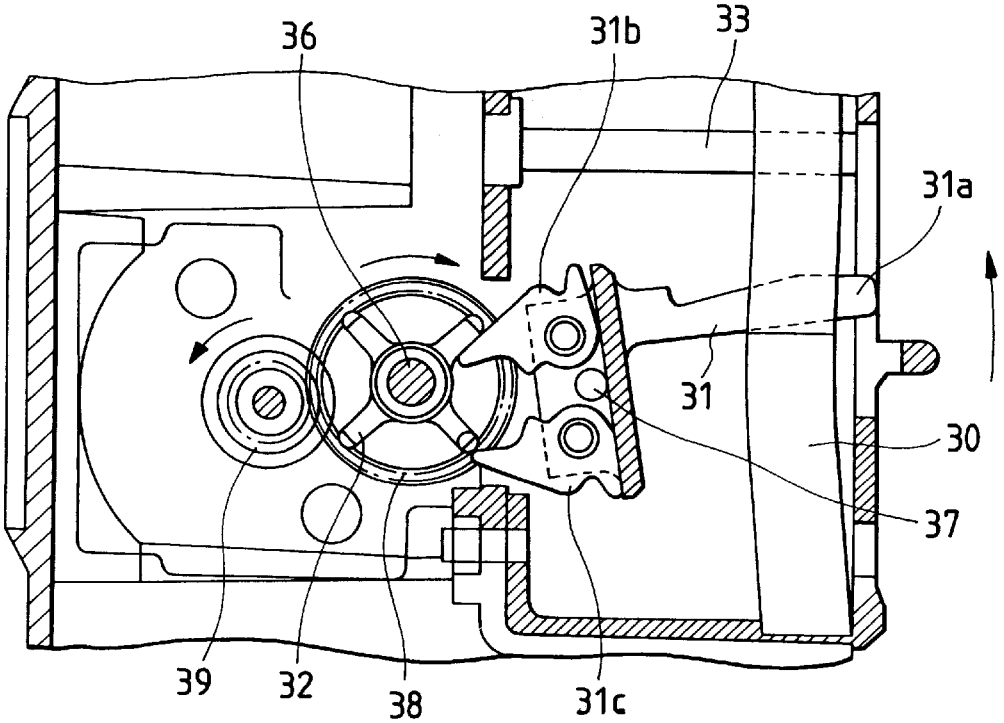
FIG. 9 is a front view showing a state of a brake lever of the brake mechanism shown in FIG. 8 in the case of applying the brake.

Next, FIGS. 8 and 9 are views showing another embodiment of the brake mechanism. Also in this example, there are provided a brake means 30 capable of engaging with the circumferential edge portion of the wire reel 2, and a brake lever 31 for operating the brake means 30. In the circumferential edge portion of the wire reel 2, the engaging recesses 13 are formed at regular intervals. There is provided a brake means 30, the shape of which is a C-shape, at a position opposed to the engaging recess 13. This brake means 30 is rotatably supported by the support shaft 33 arranged on both side walls of the wire reel accommodating section. The brake means 30 has an engaging claw 34 capable of engaging with the engaging recess 13. This engaging claw 34 is biased by the spring 41 in a direction so that it can be engaged with the circumferential edge portion of the wire reel 2. An intermediate portion of the brake lever 31 is rotatably supported by the shaft 37. One end portion 31*a* of the brake lever 31 is arranged between the brake means 30 and the wire reel 2. At the other end of the brake lever 31, there are provided a pair of engaging claws 31*b*, 31*c* which are arranged at positions so that they can be engaged with a cross-shaped protrusion 32 formed on a side of the rotary shaft 36 of the brake gear 38. The brake gear 38 is meshed with the gear 39 of the twisting motor.

Figure 10:
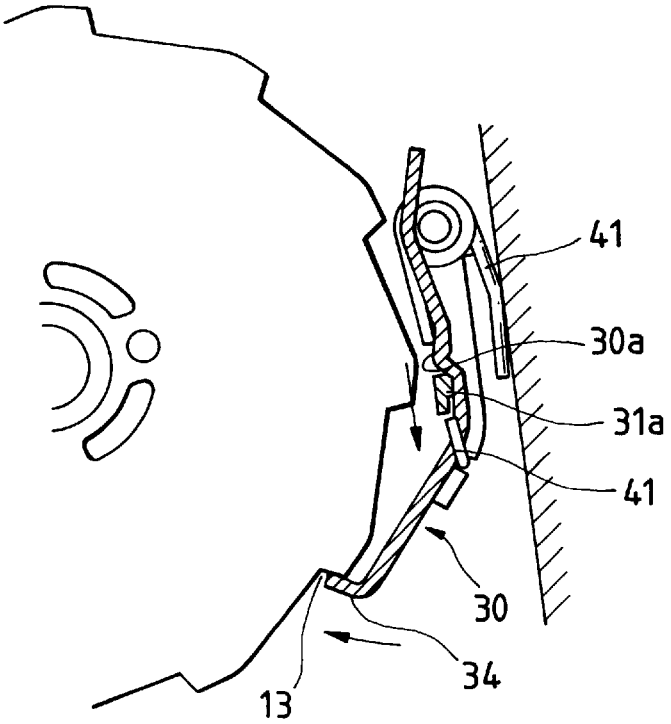
FIG. 10 is a schematic illustration showing operation of the brake lever.
Figure 11:
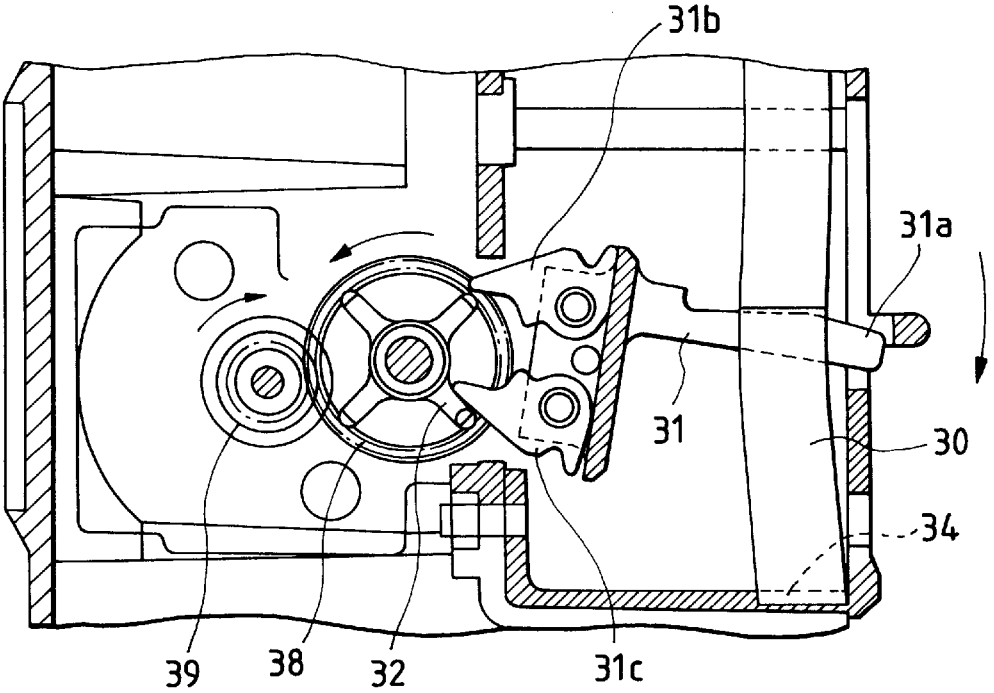
FIG. 11 is a front view showing a state of the brake lever of the brake mechanism shown in FIG. 10.

In the above arrangement, when the twisting motor is normally rotated, the brake gear 38 is also rotated as shown in FIGS. 10 and 11. When the protrusion 32 of the rotary shaft 36 is rotated, it is engaged with one engaging groove 31*b* of the end portion 31*b* of the brake lever 31, so that the end portion 31*b* is rotated upward, and the other end portion 31*a* is moved downward. In this way, the brake means 30 is pivoted by the spring 41, and the engaging claw 34 is engaged with the engaging groove 13 of the wire reel 2. Due to the foregoing, rotation of the wire reel 2 is forcibly stopped.

When the twisting motor 9 is reversed after that, the protrusion 32 of the rotary shaft 36 is engaged again with the other engaging claw 31*c* of the end portion 31*b* of the brake lever 31, and the brake lever 31 is moved in the reverse direction. Accordingly, the other end portion 31*a* of the brake lever 31 slides on the inside 30*a* of the brake means 30. Accordingly, the brake means 30 is pivoted in the reverse direction resisting a spring force generated by the spring 41. Therefore, the engaging claw 34 is retracted and disengaged from the wire reel 2. Accordingly, the braking is released from the wire reel 2. As a result, the brake means 30 is put into a state shown in FIGS. 8 and 9. Due to the foregoing, preparation is made for the wire 3 in the next stage.

Also in this case, the twisting motor 9 is operated substantially simultaneously with the completion of feed of the wire 3 of a predetermined length. When the twisting motor 9 is normally rotated, the brake means 30 is operated, so that the brake is applied to the wire reel 2 and the rotation of the wire reel 2 is suddenly stopped. Due to the foregoing, it becomes possible to feed the wire 3 smoothly.

Figure 12:
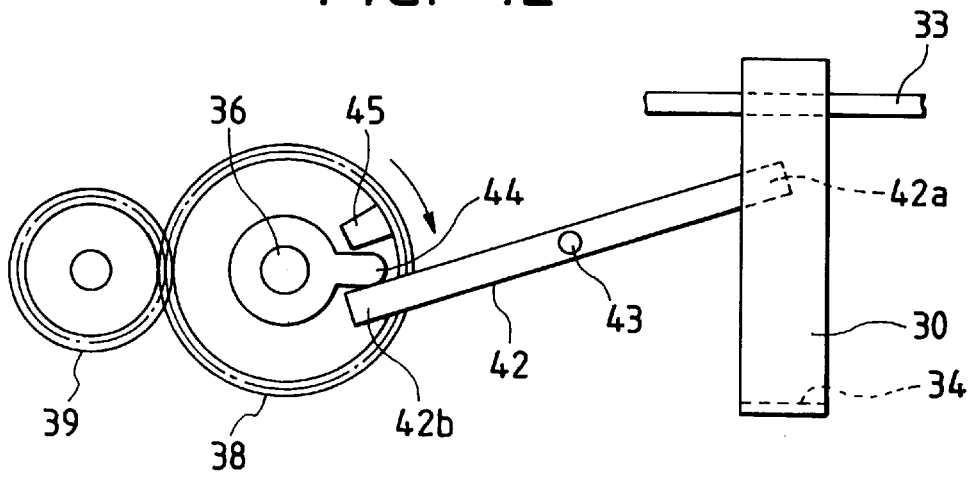
FIG. 12 is a front view a brake mechanism of still another example in the case of releasing the brake.
Figure 13:
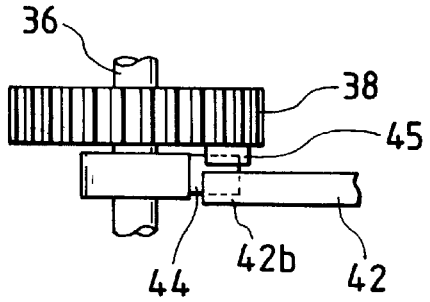
FIG. 13 is a plan view of a brake gear.
Figure 14:
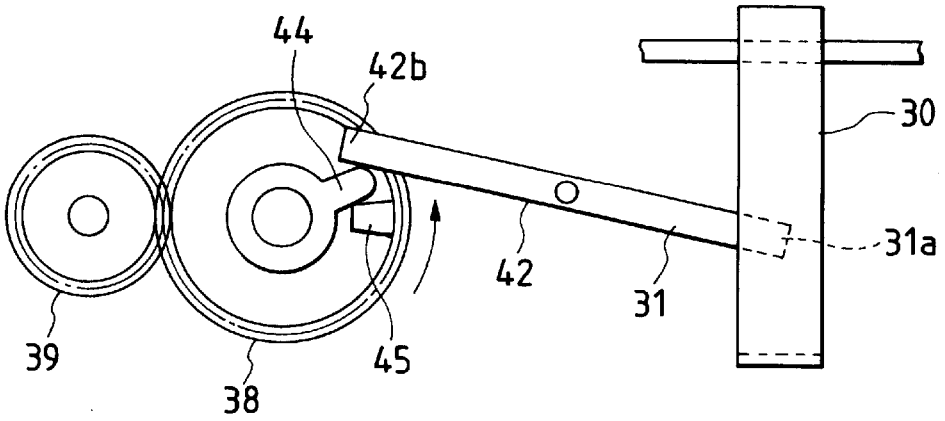
FIG. 14 is a front view showing a state of a brake lever of the brake mechanism shown in FIG. 12 in the case of applying the brake.

FIGS. 12 to 14 are views showing still another embodiment of the brake mechanism. The brake mechanism of this embodiment includes: a brake means 30, the structure of which is the same as that shown in FIGS. 8 and 9, capable of engaging with the circumferential edge portion of the wire reel; and a brake lever 42 for operating the brake means 30. In the circumferential edge portion of the wire reel, the engaging recesses (not shown) are formed at regular intervals. There is provided a brake means 30, the shape of which is a C-shape, at a position opposed to the engaging recess. This brake means 30 is rotatably supported by the support shaft 33 arranged on both side walls of the wire reel accommodating section. The brake means 30 has an engaging claw 34 capable of engaging with the engaging recess. This engaging claw 34 is biased by the spring in a direction so that it can be engaged with the circumferential edge portion of the wire reel 2. An intermediate portion of the brake lever 42 is pivotably supported by the shaft 43. One end portion 42*a* of the brake lever 42 is arranged between the brake means 30 and the wire reel 2. The other end 42*b* is arranged at a position so that the other end 42*b* can be engaged with the operational claw 44, which operates the brake lever 42, wherein the operational claw 44 is rotatably supported by the rotary shaft 36 of the brake gear 38 via a bearing. The brake gear 38 is meshed with the gear 39 for the twisting motor. On the side of the brake gear 38, there is provided a protruding portion 45. As shown in FIG. 13, this protruding portion 45 is protruded in such a manner that it is engaged with the operational claw 44, however, it is not engaged with the brake lever 42.

In the above arrangement, operation is conducted as follows. When the twisting motor 9 is normally rotated, the brake gear 38 is also rotated by 3 to 4 revolutions. Therefore, the protrusion 45 is engaged with the operational claw 44 as shown in FIG. 14. Then, the operational claw 44 is rotated and engaged with one end portion 42*b* of the brake lever 42, so that the brake lever 42 can be rotated. Accordingly, the other end portion 42*a*of the brake lever 42 is moved downward, and the brake means 30 is rotated by the spring. In this way, rotation of the wire reel is forcibly stopped in the same manner as that shown in FIG. 10.

After that, when the twisting motor 9 is reversed, the protruding portion 45 of the rotary shaft 36 is engaged again with the opposite side of the operational claw 44 as shown in FIG. 13. Therefore, the operational claw 44 moves the brake lever 42 in the reverse direction. Accordingly, the brake means 30 is rotated in the reverse direction resisting a force of the spring. In this way, the braking can be released from the wire reel.

In this connection, after the twisting motor 9 has been reversed and the braking has been released, the twisting motor might be normally rotated a little for some reasons, that is, the twisting motor might be rotated a little in a direction so that the brake can be applied. In this case, the protruding portion 45 of the brake gear 38 is rotated counterclockwise in FIG. 12. Therefore, the protruding portion 45 is separated from the operational claw 44. Therefore, no operation is conducted until the protruding portion 45 is engaged again with the operational claw 44. Until the protruding portion 45 is engaged again with the operational claw 44, the brake gear 38 must be rotated by about one revolution. Accordingly, even when the twisting motor 9 is abnormally rotated as described above, there is no possibility that the brake gear 38 is rotated by one revolution. For this reason, no brake is applied even in the case of an abnormal rotation of the twisting motor 9.

In this connection, it should be noted that the brake is not limited to the above specific embodiment in which the engaging claw of the brake means is engaged with the engaging recess of the wire reel For example, it is possible to adopt an arrangement in which a portion of the brake means composed in the same manner as that described above is strongly pressed to and engaged with the circumferential edge portion of the wire reel so that the brake can be applied to the wire reel.

What is claimed is:

1. A brake mechanism of a wire reel of a reinforcing bar binding machine in which a binding wire is fed from a wire reel rotatably arranged at the rear of the binding machine body to the front of the binding machine body, wound round reinforcing bars crossing each other, and twisted by a twisting hook driven by a motor to bind the reinforcing bars with the binding wire, the brake mechanism comprising:

braking means for engaging with a circumferential edge portion of the wire reel; and a brake lever linked with the motor for driving the twisting hook such that, when the motor normally rotates, the brake lever operates the braking means so the brake means engages with the circumferential edge portion of the wire reel so as to apply braking to the wire reel, and when the motor reversly rotates, the brake lever reversely operates the brake means to release the braking means from applying braking.

2. The brake mechanism according to claim 1, further comprising:

a rotary shaft fixed to the brake lever, the rotary shaft having a hole;

a spring inserted into the hole of the rotary shaft;

a ball, in part inserted into the hole of the rotary shaft, and receiving an urging force of the spring; and a brake gear driven by the motor, the brake gear having a central hollow portion into which the rotary shaft is inserted, and recess grooves inner of the central hollow portion for receiving a ball in part.

3. The brake mechanism according to claim 1, further comprising:

a rotary shaft;

a brake gear attached to the rotary shaft, the brake gear having plural protrusions; and a pair of engaging claws attached to the brake lever, wherein the engaging claws engage with protrusions of the brake gear such that, when the motor normally rotates, one of engaging claws contacts with either one of the protrusions and therefore moves the brake lever to operate the braking means, and when the motor reversely rotates, the other one of engaging claws contacts with either one of the protrusions and therefore moves the brake lever to release the braking means from applying braking.

4. The brake mechanism according to claim 1, further comprising:

a rotary shaft;

a brake gear attached to the rotary shaft; the brake gear having a protruding portion;

an operational claw rotatably attached to the rotary shaft, and engagable with the brake lever.

* * * * *